United States Patent [19]

Winsor

[11] 4,370,596

[45] Jan. 25, 1983

[54] SLOW-WAVE FILTER FOR ELECTRON DISCHARGE DEVICE

[75] Inventor: Donald L. Winsor, Wakefield, Mass.

[73] Assignee: Raytheon Company, Lexington, Mass.

[21] Appl. No.: 33,759

[22] Filed: May 1, 1970

[51] Int. Cl.[3] ..... H01J 25/34

[52] U.S. Cl. ..... 315/3.6

[58] Field of Search ..... 315/3.5, 39.3, 3.6; 330/43; 313/82 R

[56] References Cited

U.S. PATENT DOCUMENTS

| | | | |
|---|---|---|---|
| 2,900,557 | 8/1959 | Webber et al. | 315/3.5 |
| 2,939,035 | 5/1960 | Reuerdin | 315/3.5 |
| 3,221,205 | 11/1965 | Sensiper | 315/3.5 |
| 3,345,528 | 10/1967 | Bryant, Jr. | 313/82 R |

*Primary Examiner*—Theodore M. Blum

*Attorney, Agent, or Firm*—Philip J. McFarland; Joseph D. Pannone; Milton D. Bartlett

[57] ABSTRACT

A filter for suppressing backward wave energy modes propagating along a slow-wave structure. The filter is frequency responsive and comprises a wall having coupling apertures and, in one embodiment, a series of waveguide sections which are joined to the coupling apertures and alternate sections are terminated in matched loads. The apertured wall encloses the slow-wave structure and the apertures are arranged relative to periodic elements of the slow-wave structure such that a forward wave can propagate with substantially no interaction with the filter while the energy in a backward wave is dissipated in the matched loads. The filter is particularly adapted for absorbing backward waves in a travelling wave tube operating at high power and an octave bandwidth.

6 Claims, 7 Drawing Figures

FIG. 1
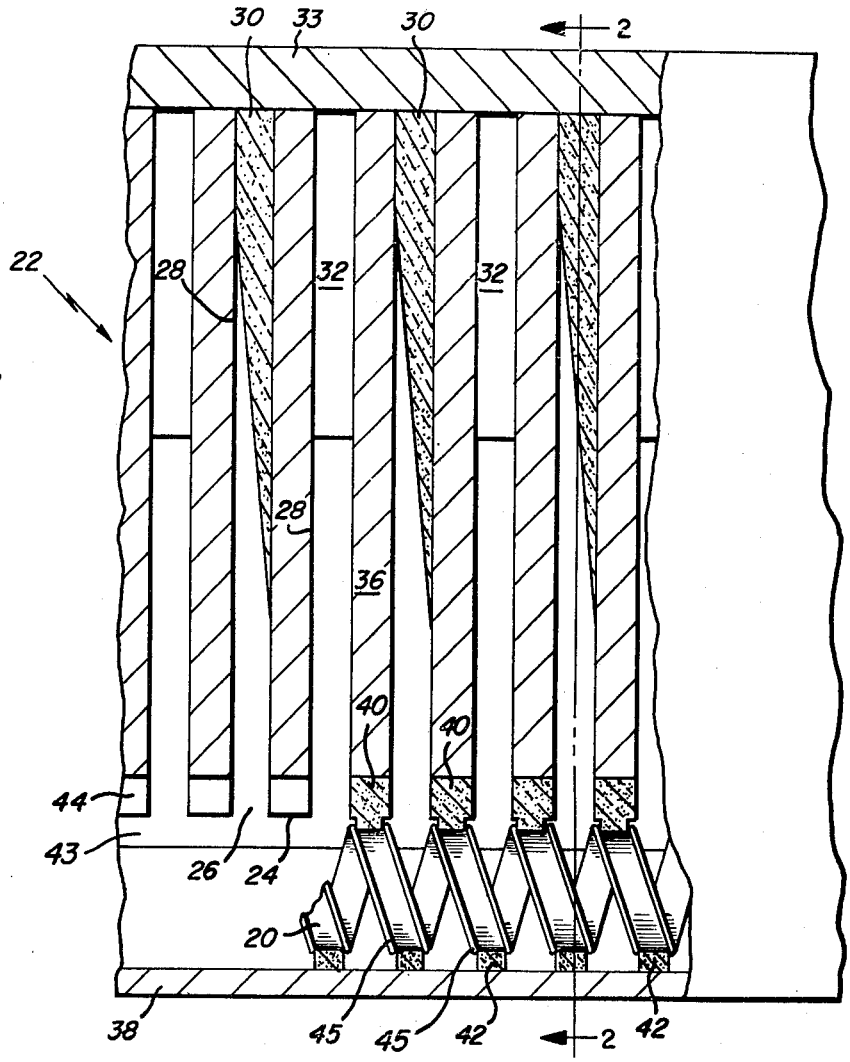
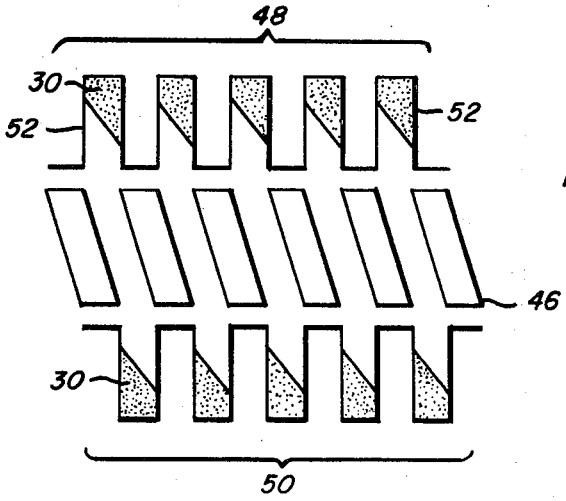
FIG. 3

SLOW-WAVE FILTER FOR ELECTRON DISCHARGE DEVICE

BACKGROUND OF THE INVENTION

This invention relates to wave propagation devices and more particularly to a filter adapted for use with a wave propagation structure to filter out harmonic components of a wave propagating along the wave propagation structure.

Wave propagation structures, particularly slow-wave structures, have been used extensively is travelling wave tubes (TWT) to provide controlled reaction of a travelling electromagnetic wave with high velocity electrons in an electron beam. A helix is frequently employed as a slow-wave structure in a TWT designed for wide-bandwidth operation, such bandwidths being in excess of one octave. Unfortunately, such wide-band TWT's have, in the past, been restricted to relatively low power outputs as compared to narrow-band TWT's employing resonant slow-wave structures such as coupled cavity resonators.

In the operation of a TWT utilizing a helix as the slow-wave structure, a beam of electrons is transmitted down the helical axis within the region enclosed by the helix, generally known as the interaction region. An input RF signal is coupled to the helix and travels along the helix in the form of a slow wave having an electromagnetic field both within and without the helix. The pitch of the helix is selected so that the velocity of the slow wave along the helical axis is approximately equal to the velocity of the electrons in the interaction region so that these electrons can interact with the slow wave to impart energy to and amplify the slow wave. For operation of a TWT at relatively high values of output power, relatively high values of electron beam current and voltage are utilized. Since an increased beam voltage results in an increased electron velocity, the pitch of the helix is relatively large to provide a higher slow-wave velocity.

A problem arises in the operation of a wideband TWT at high power levels because the increased helical pitch affects the interaction of the electron beam with the slow wave travelling along the helix. The electric field distributions of the various modes of the slow wave, particularly the forward wave and the backward wave, in the interaction region vary in accordance with the pitch of the helix. While both tightly wound and stretched out helices provide good interaction between the forward wave and the electron beam, a stretched out helix provides significantly greater interaction between the backward wave and the electron beam than does a tightly wound helix. As is well known, the backward wave transports energy in the direction reverse to the forward wave and is amplified by the electron beam, the amount of amplification depending on the extent of the interaction between the backward wave and the electron beam. When sufficient interaction is obtained, the TWT oscillates with the result that the output signal of the TWT bears little or no resemblance to the input signal. Such interaction with the attendant oscillation has proved to be an upper limit to power output in travelling wave tube amplifiers of the prior art employing a helical wide-band slow-wave structure.

It is, therefore, an object of the present invention to increase the power of a wideband travelling wave tube.

It is also an object of the present invention to provide a means for filtering out a backward wave propagating along a slow-wave structure.

It is furthermore an object of the present invention to improve the stability of a travelling wave tube amplifier employing a helical slow-wave structure wherein the helical pitch has been increased to such a high value that the helix advances along its axis a distance of almost one helix diameter during a single turn of the helix.

SUMMARY OF THE INVENTION

The foregoing objects and other advantages are accomplished by the present invention which provides an apertured wall positioned along a wave propagating structure, such as the helical slow-wave structure of a travelling wave tube. Frequency responsive transmission line means, such as waveguides, connect with the apertures in the apertured wall and are coupled, preferably by dielectric elements, to successive portions of the slow-wave structure. The transmission line means, being frequency responsive, function as a filter to couple energy from waves propagating along the slow-wave structure in a predetermined frequency band. Thus, for example, with waveguides serving as the transmission lines means, the cross sectional dimensions of the waveguides are selected to provide a predetermind cut-off frequency such that energy in waves propagating along the slow-wave structure and having frequencies above the predetermined cut-off frequency is coupled into the waveguides and conducted away from the slow-wave structure. However, waves propagating along the slow-wave structure and having frequencies below the predetermined cut-off frequency progress along the slow-wave structure with essentially no interaction with the waveguides. When the apertured wall and the transmission line means are utilized in a travelling wave tube, high powered pulses of RF energy can propagate along the slow-wave structure with no more than a negligible interference from propagating waves, particularly backward waves, having a frequency different from that of the RF energy.

BRIEF DESCRIPTION OF THE DRAWINGS

The aforementioned objects and other features of the invention are explained in the following description taken in connection with the accompanying drawings wherein:

FIG. 1 is an elevation view, partially cut away, of a waveguide filter assembly, in accordance with the invention, coupled to a helical slow-wave structure;

FIG. 3 is a diagrammatic view of an alternative filter assembly;

DESCRIPTION OF THE PREFERRED EMBODIMENT

Figure 2:
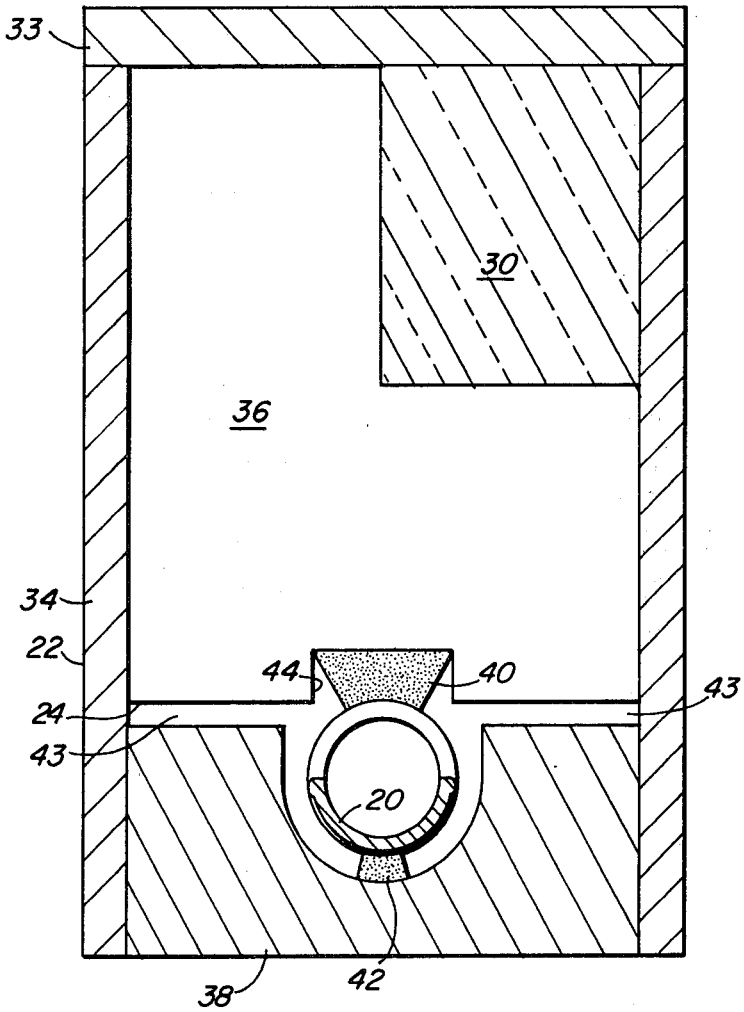
FIG. 2 is a sectional view taken along the line 2—2 of FIG. 1.

Referring now to FIGS. 1 and 2, there is shown a wave propagating structure in the form of a helix 20 which can propagate both forward and backward waves when suitably excited from a source of radio frequency (RF) energy as will be described below with reference to FIGS. 4 and 6. The helix 20 has the form of a tape helix made from a length of tape, the tape being of electrically conductive material such as copper. In this embodiment the width of the tape has been chosen such that the spacing between turns of the helix 20 is approximately equal to the tape width, and the pitch of the helix 20 is such that the helix advances along its axis a distance of approximately one diameter of the helix during a single turn of the helix. A filter assembly 22 in accordance with the invention has a surface 24 which is spaced apart from the helix 20 by a distance of approximately one tape width and has a plurality of apertures 26 so that RF energy in the frequency region where backward wave oscillations are encountered can be coupled through the apertures 26 and lead away from the helix 20, while RF energy in the frequency region normally used for amplification can propagate along the helix 20 substantially unimpeded by the filter assembly 22.

The filter assembly 22 comprises a series of transmission lines in the form of waveguides 28 terminating in the apertures 26 for conducting RF energy away from the helix 20. Alternate waveguides 28 contain energy dissipation material such as carbon particles embedded in an alumina matrix to form matched loads 30 which serve the dual functions of absorbing RF power and substantially eliminating any reflections of RF power back towards the helix 20. The other waveguides 28 contain shorting bars 32 at approximately ¼ the backward wavelength from the apertures 26, which tune the filter assembly 22 for coupling with the backward wave. The waveguides 28 and shorting bars 32 are composed of a metallic material such as copper which is well suited for dissipation of heat resulting from the absorbed RF power. The waveguides 28 may be closed off by a metallic plate 33 or alternatively by a metallic envelope described below with reference to FIG. 4.

The cross sectional dimensions of a waveguide 28 are selected as follows: Waveguide 28 has short walls 34 disposed parallel to the axis of helix 20, and long walls 26 disposed across, or perpendicularly to, the axis of the helix 20. The long walls 36 of a waveguide 28 are spaced apart by a distance approximately equal to the spacing between turns of the helix 20. The short wall 34 of the waveguides 28 are spaced apart such that the diagonal of the waveguide cross section is greater than one-half wave length of the backward wave oscillation frequency which is to be coupled into the waveguide 28, to substantially inhibit amplification of energy modes at this frequency but smaller than one-half wavelength of the forward wave oscillation frequency which is to propagate along the helix 20 without any interaction with waveguide 28 other than producing a relatively insignificant evanescent mode in the waveguide 28. The diagonal establishes the low frequency cut-off value of the waveguide 28 so that the waveguides 28 can function as a filter responsive to the backward wave frequencies of waves propagating along the helix 20.

The filter assembly 22 and a cover 38 of a metal such as copper are connected together, as by brazing, to form a tubular enclosure about the helix 20 which serves to support and to cool the helix 20. The cover 38 is spaced from the surface 24 of the filter assembly 22 by a gap 43 having a width approximately ⅔ the width of the tape from which the helix 20 is fabricated. The gap 43 permits energy from a backward wave to be more readily coupled through the apertures 26 and into the waveguides 28.

The helix 20 is positioned within the tubular enclosure by means of electrically-insulating thermally-conducting mounts 40 and 42 which are made from a material, preferably beryllia though boron nitride may also be used, and are brazed respectively to the interior surfaces of the filter assembly 22 and the cover 38. The thermally conductive properties of mounts 40 and 42 are most desirable in the situation, as will be described in reference to FIG. 4, wherein the helix 20 and the filter assembly 22 are utilized in the construction of a wide-bandwidth high-power traveling wave tube wherein heat is generated by electrons striking the helix 20. The mounts 40 and 42 conduct such heat away from the helix 20 to the filter assembly 22 and the cover 38. Mount 40 subtends an arc of approximately 80 degrees around a turn of helix 20 and is affixed in a notch 4 in a long wall 36 between adjacent waveguides 28. The aforesaid shape and composition of the mount 40 aid in filtering the backward wave and in coupling the backward wave into the waveguides 28 of the filter assembly 22. Due to the relatively large area of contact between a mount 40 and a turn of the helix 20, most of the heat produced within the helix 20 is withdrawn via the mounts 40 so that the mounts 42 may be of relatively small size as is shown in FIG. 2. Mounts 42 retain a gap width between the helix 20 and the cover 38, such gap width preferably being two-thirds the width of the tape from which the helix 20 is fabricated. The tape from which helix 20 is fabricated has a pair of peripheral flanges 45, as shown in FIG. 1, such flanges aiding in the positioning of successive turns of helix 20 on their respective mounts 40 and 42.

Referring to FIG. 3, there is shown, schematically, an alternative embodiment of the invention which further demonstrates the use of apertured walls as a filter for slow-wave structures. Here a helix 46 is shown enclosed between two filter assemblies 48 and 50 each of which comprises a series of waveguides and matched loads as does the filter assembly 22 of FIG. 1. However, filter assemblies 48 and 50 differ from that of filter assembly 22 in that a matched load 30 is provided opposite each space between turns of the helix 46, while in the filter assembly 22 the matched loads 30 are positioned opposite alternate spaces between turns of helix 20. In FIG. 3 the periodicity of the array of waveguides 52 is equal to the periodicity of the helix 46, while the format of the filter assembly 22 of FIG. 1 has a period twice the length of the period of the helix 20. Furthermore, apertured walls not designated by numbers in FIG. 3, are provided both above and beneath the helix 46 by replacing the smooth surfaced cover 38 of FIG. 1 with the filter assembly 50 of FIG. 3.

Figure 4:
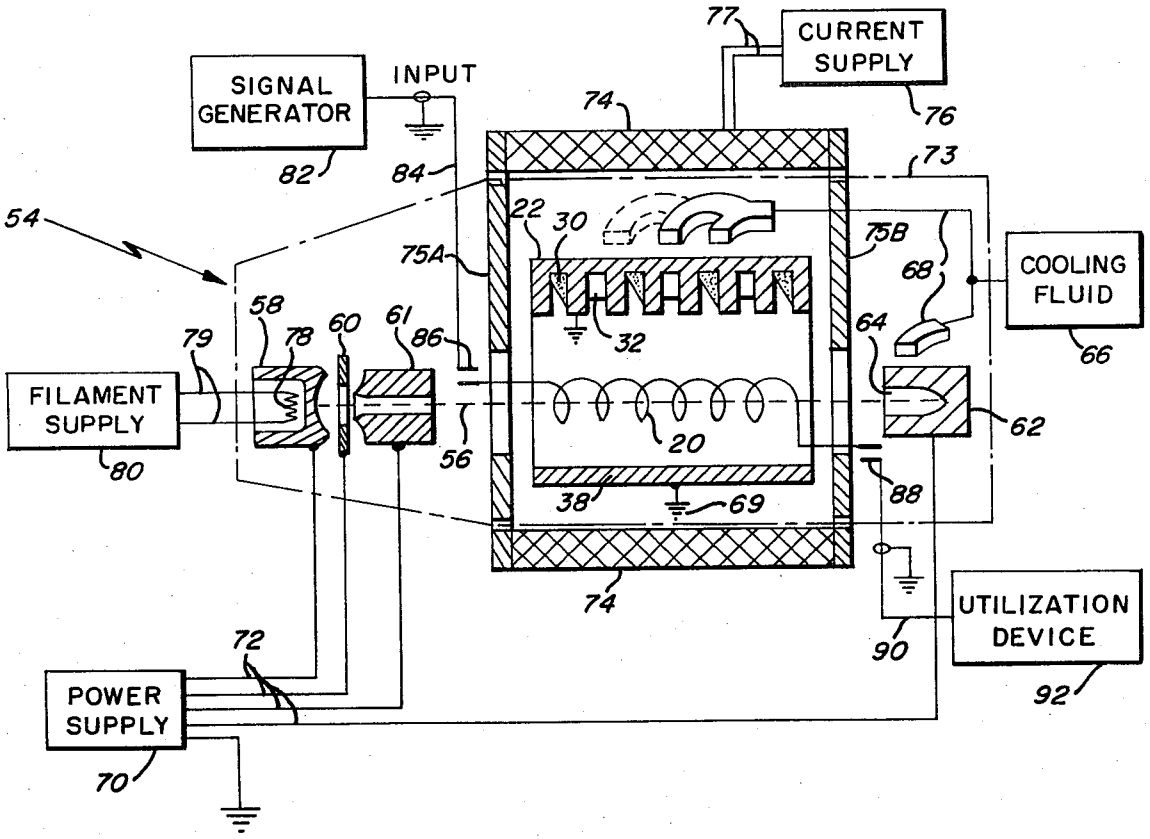
FIG. 4 is a diagrammatic view of a travelling wave tube incorporating the filter assembly of the invention for amplification of wide bandwidth signals.

Referring now to FIG. 4 there is shown a diagram of a travelling wave tube (TWT) 54 incorporating the helix 20, the filter assembly 22 and the cover 38 of FIG. 1. The unifilar helical slow-wave structure, exemplified by helix 20, is utilized in TWT 54 since this slow-wave structure is not a resonant structure as is, for example a coupled cavity slow-wave structure, and is capable of providing bandwidths in excess of one octave. Other nonresonant slow-wave structures such as the ring and bar, and the bifilar helix may also be used. The helix 20 is supported by the mounts 40 and 42 shown in FIG. 1 but not shown in FIG. 4. An electron beam 56 is provided within and coaxial to helix 20, the electron beam 56 being generated by an electron gun comprising a cathode 58, an electron beam focusing electrode 60, an anode 61 and a collector 62. The electrons in electron beam 56 have a relatively high velocity, greater than approximately 20 percent the speed of light. Collector 62 is formed of an electrically-conducting heat-dissipating material such as copper and has an interior void 64 for receiving high velocity electrons of the electron beam 56 and then dissipating the heat energy resulting from the impact of the electrons against the collector 62. Collector 62 as well as the waveguides 28 of filter assembly 22 are cooled by a fluid, such as water, supplied from a well known source of cooling fluid 66 by means of conduits 68. Power for the electron beam 56 as well as the potential (voltage) differences between the cathode 58, electrode 60, collector 62, the cover 38 and ground 69 are provided by a power supply 70 through wires 72. An envelope 73 of a metal such as cupronickel surrounds TWT 54 so that air can be evacuated from TWT 54, and contains ports (not shown) through which RF energy and cooling fluid are brought to TWT 54. A solenoid 74 energized with current from current supply 76 via leads 77 is positioned outside envelope 73 about TWT 54 to provide a magnetic field coaxial with helix 20 for confining the electron beam 56 within the helix 20. The magnetic field is focused with the aid of pole pieces 75A and 75B. Cathode 58 is heated for emission of electrons by means of a filament 78 supplied with current via leads 79 from a filament current source 80. The voltages provided by power supply 70 are set in accordance with the pitch of helix 20 such that the velocity of electrons in the electron beam 56 is approximately equal to the velocity of propagation of the forward wave on the helix 20.

A wide band RF signal occupying an octave spectrum, for example from 1 gHz to 2 gHz, is provided by signal generator 82 and is conducted to TWT 54 via coaxial transmission line 84 and input coupling 86 which is described in greater detail hereinafter with reference to FIG. 6. The RF signal is then amplified by TWT 54 and extracted via an output coupling 88, to be described with reference to FIG. 6, and conducted via coaxial transmission line 90 to a utilization device 92 which may be, for example, an antenna for transmitting the signal to a distant location. In particular, it is noted that high powered signals, in excess of a few kilowatts of average power and of an octave bandwidth as can be provided by TWT 54, are well suited, for example, in tests of atmospheric frequency dispersion and channel fading.

Figure 5:
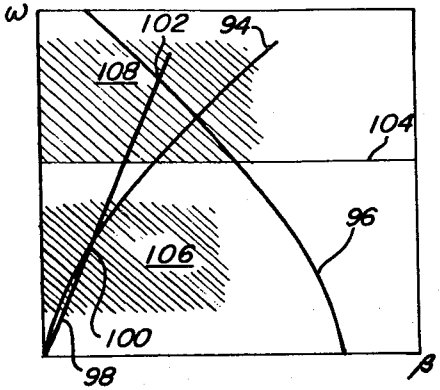
FIG. 5 is a Brillouin diagram for the travelling wave tube of FIG. 4 and includes the frequency response characteristic of the filter assembly of FIG. 1.

Referring now to FIG. 5, there is shown a well known Brillouin diagram (also known as $\omega$-$\beta$ diagram) for the periodic structure of the helix 20. This diagram is useful for showing the fundamental mode of the forward wave indicated by curve 94, and of the backward wave, indicated by curve 96. Only one space harmonic is shown for each of the waves. The radian frequency, $\omega$, and the propagation constant, $\beta$, for the waves are indicated respectively by the vertical and horizontal axes. The slope of line 98 indicates the velocity of electrons in the electron beam 56 and the intersection 100 of line 98 with curve 94 indicates the value of $\omega$ and $\beta$ of a forward wave of the same velocity as the electrons. Line 98 also intersects curve 96, at a point of intersection 102 indicating the values of $\omega$ and $\beta$ of a backward wave which interacts with the electron beam. It is this backward wave which induces oscillation in TWT 54. It is apparent from FIG. 5 that the intersection 102 occurs at a higher frequency than the intersection 100 and that, therefore, it is possible to filter out the backward wave. Line 104 indicates the cut-off frequency of the filter assembly 22 from which it can be seen that the filter assembly 22 filters out the backward wave while allowing the forward wave to propagate along the helix 20. The shaded region 106 indicates a range of frequencies for the RF signal over which TWT 54 normally operates as an amplifier, while the shaded region 108 indicates a band of frequencies over which RF energy is absorbed by the filter assembly 22. In this way the TWT 54 can operate at high power with the attendant high electron velocity while the power of the backward wave is reduced to a sufficiently small value to preclude oscillations. It is also noted that energy in harmonics of the fundamental frequency of the RF signal, such as is produced by interaction of the forward wave with the high speed electrons, can be absorbed by filter assembly 22 when such harmonics have values above that represented by line 104.

Figure 6:
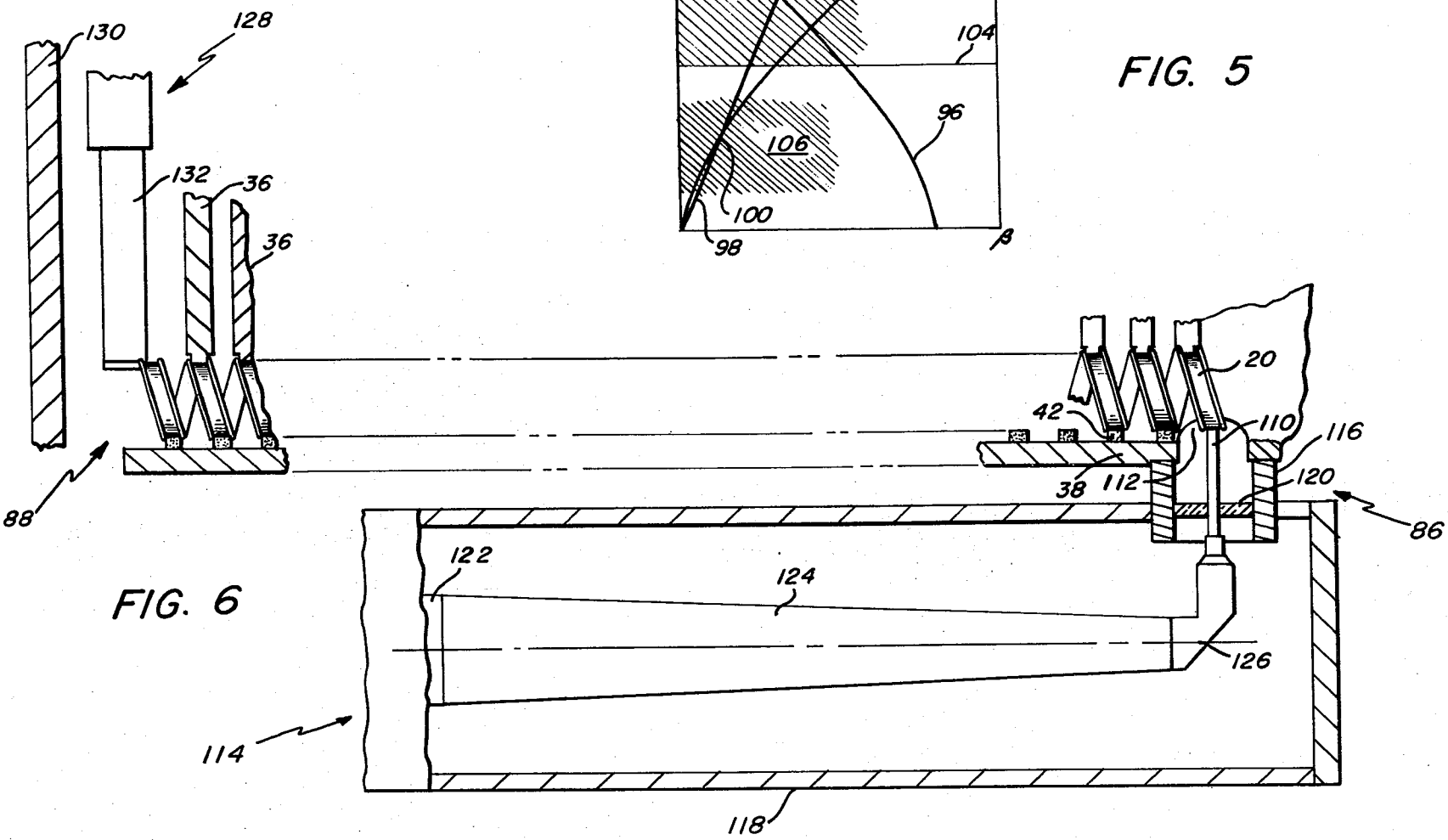
FIG. 6 is detailed view of the input and output couplings for the travelling wave tube of FIG. 4.

Referring now to FIG. 6 there is shown a detailed view of the input coupling 86 and the output coupling 88. The input coupling 86 comprises a post 110 of a metal such as copper passing through an aperture 112 in the cover 38 and affixed, as by welding, to an end of helix 20. Post 110 is a portion of an inner conductor of a coaxial transmission line 114. The outer conductor of coaxial transmission line 114 is fabricated from a metal such as copper and comprises a short section 116 of relatively small cross section and a long section 118 having a larger cross section to mate with standard size coaxial transmission line such as coaxial transmission line 84 of FIG. 4. Post 110 is positioned along the center of the short section 116 by means of a disk 120 of a material such as beryllia which is electrically insulating and also is thermally conducting so as to withdraw excess heat from the post 110. The long section 118 of coaxial transmission line 114 has an inner conductor 122 of standard size which connects with the post 110 by means of an impedance transformer or transition whereby a TEM wave is coupled from the long section 118 to the short section 116. The transition comprises a tapered rod 124 connecting with post 110 by means of an end fitting 126. The use of a transition having a right angle form as shown in FIG. 6 provides for a savings in space and a more compact overall structure for TWT 54.

The output coupling 88 is of similar design to the input coupling 86 and comprises a coaxial transmission line 128 with outer conductor of rectangular cross section of which a wall 130 is shown in FIG. 6 and a second wall 36 is shared with the filter assembly 22. Center conductor 132 of the transmission line 128 affixed as by welding to the output end of the helix 20. Coaxial transmission line 128 is connected via a well known transition (not shown in FIG. 6) to coaxial transmission line 90 shown in FIG. 4.

The TWT 54 can be utilized for both an RF signal which is pulsed and for an RF signal which is continuous. The advantage of the filter assembly 22 is most fully appreciated in the case of a pulse signal where the peak power output can be well in access of 10 kilowats. In the generation of such high values of peak power it is most desirable to precisely focus the electron beam 56 in the helix 20 of FIG. 4 to minimize the number of electrons which strike the helix 20. When TWT 54 is utilized to modulate the input RF signal, such as by pulsing this RF signal, a control grid not shown in FIG. 4 is to be included with the focusing electrode 60, such grid being energized, in a well known manner, with voltages of suitable magnitudes to pulse electron beam 56 ON and OFF. Thus, an electron gun is required for TWT 54 which can provide the functions of pulsing the electron beam 56 in addition to precisely focusing the electron beam 56.

Figure 7:
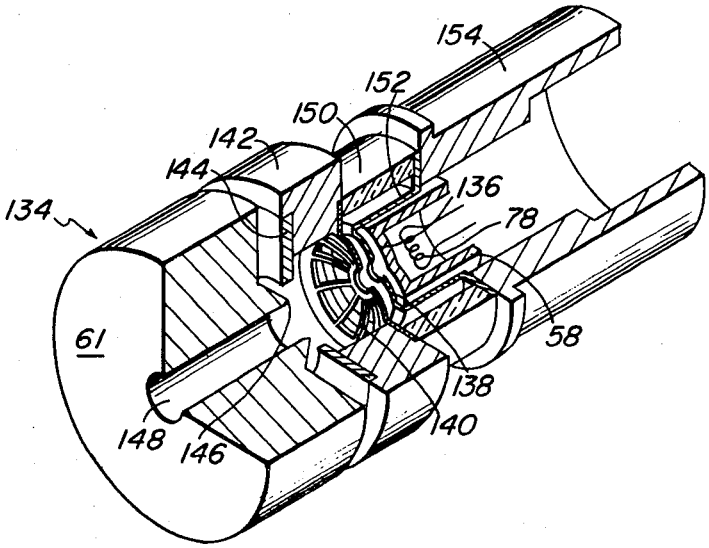
FIG. 7 is an isometric view, partially cut away, showing means for generating an electron beam within the travelling wave tube of FIG. 4.

Referring now to FIG. 7 there is shown a suitable electron gun 134 which can provide precise focusing of the electron beam 56 of FIG. 4 as well as pulsing of this electron beam. The electron gun 134 comprises the cathode 58, the heater 78 and the anode 61 which have been shown schematically in FIG. 4. Cathode 58 has a concave emitting surface 136 which is typically spherical. A shadow (or masking) grid 138 having a curvature similar to that of the emitting surface 136 is spaced a short distance, on the order of a few thousandths of an inch, in front of the emitting surface 136 and is maintained at the same electrical potential as the emitting surface 136. The shadow grid 138 shields the emitting surface 136 from the high potential difference, typically well above 10 kilovolts, between the anode 61 and the cathode 58 with the result that electrons are emitted selectively from the emitting surface 136 to pass between the radial members of the shadow grid 138. Radial grid members are utilized here since they provide for improved focusing of an electron beam. A control grid 140 for pulsing an electron beam has radial members and a curvature similar to that of shadow grid 138 and is disposed in front of the shadow grid 138 so that the radial members of control grid 140 fall within the shadow region provided by the radial members of the shadow grid 138. In this manner the shadow grid 138 protects the control grid 140 from collision with electrons emitted from cathode 58. Such protection is most desirable with the high electron beam currents utilized for high power RF signals. A focusing electrode 142 has a ring 144 for shaping the equipotential surfaces, the potential difference between the focusing electrode 142 and the cathode 58 being on the order of several hundreds volts. The control grid 140 is maintained at the same potential as the focusing electrode 142. The focusing electrode 142 is disposed between the anode 61 and the control grid 140 such that a lip 146 surrounding a central bore 148 of the anode 61 extends to the center of the ring 144. The shadow grid 138 and the control grid 140 are spaced apart by means of a ceramic spacer 150 which contacts an extension 152 of the shadow grid 138. The extension 152 is affixed to a housing 154. The housing 154 also supports the control grid 140 and the focusing electrode 142 by means of the ceramic spacer 150. The anode 61 is supported relative to the housing 154 by means of a second ceramic support not shown in FIG. 7.

A test of the insertion loss of TWT 54, a test known as a "cold" test with the electron beam turned off, was performed by inserting an RF signal of a known power into input coupling 86, measuring the output power obtained at output coupling 88 and then comparing the output power with the input power. The insertion loss was found to be dependent on the frequency of the RF signal, and a jump in insertion loss on the order of thirty decibels was noted at the cut-off frequency of the waveguides 28 of filter assembly 22, there being a relatively low insertion loss at frequencies below the cut-off frequency and a relatively high insertion loss at frequencies above the cut-off frequency. Furthermore, the filtering within TWT 54 differs from that of a filter employing resonant elements with little energy dissipation in that a relatively low standing wave ratio, typically less than approximately five, is obtained at those frequencies where the insertion loss is relatively high.

It is understood that the above described embodiments of the invention are illustrative only and that modifications thereof will occur to those skilled in the art. Accordingly, it is desired that this invention is not to be limited to the embodiment disclosed herein but is to be limited only as defined by the appended claims.

What is claimed is:

1. A traveling wave electron interaction device comprising:

a helical periodic electromagnetic energy slow-wave propagating structure comprising a plurality of spaced elements;

a plurality of dielectric members contacting each of said slow-wave structure elements and defining therebetween a plurality of spaced apertures; and a filter assembly comprising a plurality of waveguides periodically successively contacting the dielectric members on at least one side of said slow-wave structure;

said waveguides defining therebetween a parallel plate transmission line having a predetermined cutoff frequency characteristic to substantially inhibit propagation of energy in the backward wave mode without substantially perturbing amplification of forward wave modes of said energy propagating along said structure.

2. The device according to claim 1 wherein alternate waveguides include means for dissipation of said energy.

3. The device according to claim 1 wherein said alternate waveguides are provided with a lossy dielectric material for dissipating said energy and the intermediate waveguides are provided with conductive members for tuning the filter assembly to be resonant at the predetermined backward wave oscillation frequency.

4. The device according to claim 1 wherein said waveguides are disposed symmetrically on opposite sides of said slow-wave structure.

5. The device according to claim 1 wherein the periodicity of said parallel plate transmission line substantially matches the periodicity of said slow-wave structure.

6. A traveling wave electron interaction device comprising:

a helical periodic slow-wave structure having a plurality of spaced elements for propagating electromagnetic wave energy;

means for generating and directing a beam of electrons along the longitudinal axis of said slow-wave structure to interact in an energy exchanging relationship with the propagated wave energy; and a filter assembly comprising a plurality of waveguides periodically successively coupled to each of the spaces on at least one side of said slow-wave structure and dielectric members disposed at the point of contact of said waveguide walls and said elements;

said waveguides defining therebetween a parallel plate transmission line having a predetermined cutoff frequency characteristic to substantially inhibit interaction with backward wave energy modes; and lossy dielectric means for substantially absorbing such energy in the backward wave mode disposed in alternate waveguides.

* * * * *